US009878887B2

(12) United States Patent
Simpson

(10) Patent No.: US 9,878,887 B2
(45) Date of Patent: Jan. 30, 2018

(54) UPRIGHT FOR A LIFT TRUCK

(71) Applicant: Clark Material Handling Company, Lexington, KY (US)

(72) Inventor: Clark C. Simpson, Nicholasville, KY (US)

(73) Assignee: CLARK MATERIAL HANDLING COMPANY, Lexington, KY (US)

( * ) Notice: Subject to any disclaimer, the term of this patent is extended or adjusted under 35 U.S.C. 154(b) by 413 days.

(21) Appl. No.: 14/458,609

(22) Filed: Aug. 13, 2014

(65) Prior Publication Data

US 2015/0075913 A1 Mar. 19, 2015

Related U.S. Application Data

(63) Continuation-in-part of application No. 12/691,079, filed on Jan. 21, 2010, now Pat. No. 8,833,523, which is a continuation-in-part of application No. 12/690,639, filed on Jan. 20, 2010, now Pat. No. 8,434,598.

(60) Provisional application No. 61/205,204, filed on Jan. 20, 2009.

(51) Int. Cl.

| | |
|---|---|
| ***B66F 9/08*** | (2006.01) |
| ***B66F 9/18*** | (2006.01) |
| ***B66F 9/075*** | (2006.01) |

(52) U.S. Cl.

CPC ..... *B66F 9/075* (2013.01); *B66F 9/08* (2013.01); *B66F 9/18* (2013.01); *Y10S 414/123* (2013.01); *Y10S 414/124* (2013.01)

(58) Field of Classification Search

CPC ..... B66F 9/075; B66F 9/08; Y10S 414/123; Y10S 414/124

See application file for complete search history.

(56) References Cited

U.S. PATENT DOCUMENTS

| | | | |
|---|---|---|---|
| 1,661,386 | A | 3/1928 | Remde |
| 3,705,658 | A | 12/1972 | Hugh |
| 3,709,393 | A | 1/1973 | Mc Gehee |
| 3,730,368 | A | 5/1973 | Dalgish |
| 3,734,328 | A | 5/1973 | Dalglish |
| 3,774,727 | A | 11/1973 | Berkestad |
| 4,212,478 | A | 7/1980 | McGrath, Jr. |
| 4,279,567 | A | 7/1981 | Thompson |
| 4,593,883 | A | 6/1986 | Nelson |
| 4,657,112 | A | 4/1987 | Ream et al. |
| 4,848,520 | A | 7/1989 | Gibel et al. |
| 5,163,725 | A | 11/1992 | Leweallyn |
| 5,174,710 | A | 12/1992 | Dragos |

(Continued)

FOREIGN PATENT DOCUMENTS

| | | | |
|---|---|---|---|
| DE | 3532827 | A1 | 3/1986 |
| DE | 19515436 | C1 | 10/1996 |

(Continued)

*Primary Examiner* — William A Rivera
*Assistant Examiner* — Stefan Kruer
(74) *Attorney, Agent, or Firm* — King & Schickli, PLLC

(57) ABSTRACT

An upright for a lift truck includes a first group of mast sections in a first stagger arrangement where a first mast section of the first group of mast sections is fixed to the lift truck. The upright further includes a second group of mast sections in a second stagger arrangement that is reverse nested inside the first stagger arrangement. Further, the upright includes a drive system for telescopingly extending and retracting the second mast sections relative to the first mast section.

5 Claims, 14 Drawing Sheets

(56) References Cited

U.S. PATENT DOCUMENTS

| | | | |
|---|---|---|---|
| 5,203,425 | A | 4/1993 | Wehmeyer |
| 5,320,197 | A | 6/1994 | Connerley et al. |
| 5,326,217 | A | 7/1994 | Simpson et al. |
| 5,374,156 | A | 12/1994 | Simpson et al. |
| 6,095,286 | A | 8/2000 | Citron et al. |
| 7,011,487 | B2 | 3/2006 | Kafka et al. |
| 8,434,598 | B2 | 5/2013 | Simpson |
| 2002/0110446 | A1 | 8/2002 | Smith |
| 2005/0019144 | A1 | 1/2005 | Neria |
| 2007/0007081 | A1 | 1/2007 | Lewis et al. |
| 2010/0181147 | A1 | 7/2010 | Simpson |

FOREIGN PATENT DOCUMENTS

| | | | |
|---|---|---|---|
| EP | 1151959 | A1 | 11/2001 |
| GB | 2081670 | A | 2/1982 |
| GB | 2141098 | A | 12/1984 |
| JP | S52123066 | A | 10/1977 |
| JP | H02225300 | A | 9/1990 |
| JP | H090774933 | A | 3/1997 |

UPRIGHT FOR A LIFT TRUCK

This application is a continuation of U.S. patent application Ser. No. 12/691,079 filed on 21 Jan. 2010, which is a continuation-in-part of prior U.S. patent application Ser. No. 12/690,639 filed on 20 Jan. 2010 (now U.S. Pat. No. 8,434,598), which claims the benefit of U.S. Provisional Patent Application Ser. No. 61/205,204 filed on 20 Jan. 2009, the entire disclosures of which are incorporated herein by reference.

TECHNICAL FIELD

The present invention relates generally to the lift truck field and, more particularly, to a new and improved upright for a lift truck as well as a lift truck equipped with that upright.

BACKGROUND OF THE INVENTION

As is known, lift trucks are often used to lift and carry loads, such as rolled carpets. Lift trucks usually include: (a) steerable and drive wheels for propelling and maneuvering the lift truck over a surface, (b) an upright and carriage system for handling loads and (c) a power source and drive system for propelling the truck and operating truck systems including the upright and carriage system. Typically the uprights include multiple stages in order to allow the load to be lifted to a required height above ground level including, for example, up to twenty-eight feet above ground level. This allows loads to be positioned on storage racks, into over-the-road trailers, into ocean-going freight containers or the like.

The present invention relates to a five stage upright for a lift truck. Two different types of five stage uprights are known in the art. The first, known as a "six pack", incorporates two "triple stage" uprights that are fastened one in front of another. This arrangement uses a total of six rail sets or mast sections arranged generally as illustrated in FIG. 10*a*. The hydraulic systems for these uprights are designed for the normal six thousand to eight thousand pound loads of the truck models to which the six-pack upright is normally attached. The other method is known as "quad-plus-one". In a quad-plus-one upright a conventional four rail or "quad" upright has an additional rail set or mast section added in front of the existing four mast sections as illustrated in FIG. 10*b*.

The prior art six-pack and quad-plus-one uprights are effective to provide five stages to reach a given lift height. It should be appreciated, however, that each of these designs suffers from a number of significant draw-backs. In the case of the six-pack upright, six separate mast sections are utilized in order to provide a five stage lift. The extra mast section adds unnecessary weight to the upright which reduces load capacity and adversely affects the battery life of an electrically powered lift truck. The stacking of the mast sections in the fore/aft direction also increases the load center which further reduces lifting capacity. It also adds length to the truck thereby increasing the aisle space necessary to allow effective operation of the truck.

The quad-plus-one upright suffers from similar disadvantages. Once again, the fore/aft stacking of the mast sections increases the load center thereby reducing lifting capacity. It also increases the overall length of the truck thereby limiting operation of the truck to warehouses and areas with wider aisle ways. Since space within a warehouse is limited, wider aisle ways reduce available storage space which is a primary customer concern.

The present invention relates to a five stage upright specially designed to provide the desired relatively high lift height with a relatively low overall truck height that allows placing loads on racks up to twenty-eight feet in height as well as into over the road trailers and ocean going freight containers. The five stage upright rail configuration of the present invention has been widened to closely fit between the drive tires of the lift truck. The widening of the rail system adds to the lateral stability of the lift truck when under load.

The "rail nest" consists of five rails arranged with the innermost three rails with the same general arrangement as a three rail nested upright where the rails are staggered forward. The additional two rails in the five-stage located outboard of the inner three rails are staggered forward, but in an opposite direction, i.e., reverse nested. The result in that the depth or fore and aft dimension of the five stage rails is essentially the same as a three rail upright. This reduction in the dimension from the load face to the centerline of the drive wheels adds significantly to the load capacity of the lift truck.

There are some additional noteworthy advantages from the new arrangement. The most dramatic is the reduction of the load center: that is, the dimension from the centerline of the drive wheels to the load face. This represents a change from approximately 36 inches for the six-pack upright system and approximately 30 inches for the quad-plus-one upright system to 21.4 inches for the five stage upright of the current invention. This reduction in load center allows using a smaller upright system and a smaller base lift truck chassis to carry the same load. The nominal forklift chassis can be reduced from 8000 lb capacity with a service weight of 13,649 lb to a smaller 6500 lb capacity with a weight of 11,828 lb. The smaller chassis size reduces the initial cost as well as reducing the operating cost and energy consumption while doing the same work.

The space between the innermost rails is larger than with conventional designed five and six rail "narrow" uprights. This significantly improves the width of the "vision window" that the operator must look through. The width is similar to the spaces found in a conventional three rail upright. This also leaves room to use twin lift cylinders to lift the load engaging structure, the "carriage" and remove the normal single cylinder mounted in the center. Removing the center cylinder allows the carriage to extend backward between the front pair of rails, contributing to the reduction in load center. This is especially significant because it allows the operator to "sight down" the carpet pole to align the pole with the carpet to be handled.

SUMMARY OF THE INVENTION

In accordance with the purpose of the present invention as described herein, an upright for a lift truck is provided. The upright comprises a first group of mast sections in a first stagger arrangement, a first mast section of said first group of mast sections being fixed to the lift truck. The upright further includes a second group of mast sections in a second stagger arrangement reverse nested inside the first stagger arrangement. In addition, the upright includes a drive section for telescopically extending and retracting the mast sections relative to the first mast section.

In accordance with an additional aspect of the present invention there is provided a lift truck having (a) steerable and drive wheels for propelling and maneuvering the truck over a surface, (b) an upright and carriage system for handling loads and (c) a power source and drive system for propelling the truck and operating truck systems including the upright and carriage system. The improvement to the lift truck comprises a five stage upright including first and second mast sections in a first stagger arrangement, where the first mast section is fixed to the lift truck, and third, fourth and fifth mast sections in a second stagger arrangement reverse nested inside the first stagger arrangement.

In accordance with still another aspect of the present invention a method of manufacturing an upright with an improved load center and a reduced overall fore/aft dimension is provided. That method comprises providing a first group of mast sections in a first stagger arrangement and providing a second group of mast sections in a second stagger arrangement reverse nested inside the first stagger arrangement.

In the following description there is shown and described several different embodiments of the invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the present invention and together with the description serve to explain certain principles of the invention. In the drawings.

Reference will now be made in detail to the present preferred embodiment of the invention, examples of which are illustrated in the accompanying drawings.

DETAILED DESCRIPTION OF THE PREFERRED EMBODIMENTS OF THE INVENTION

Figure 1:
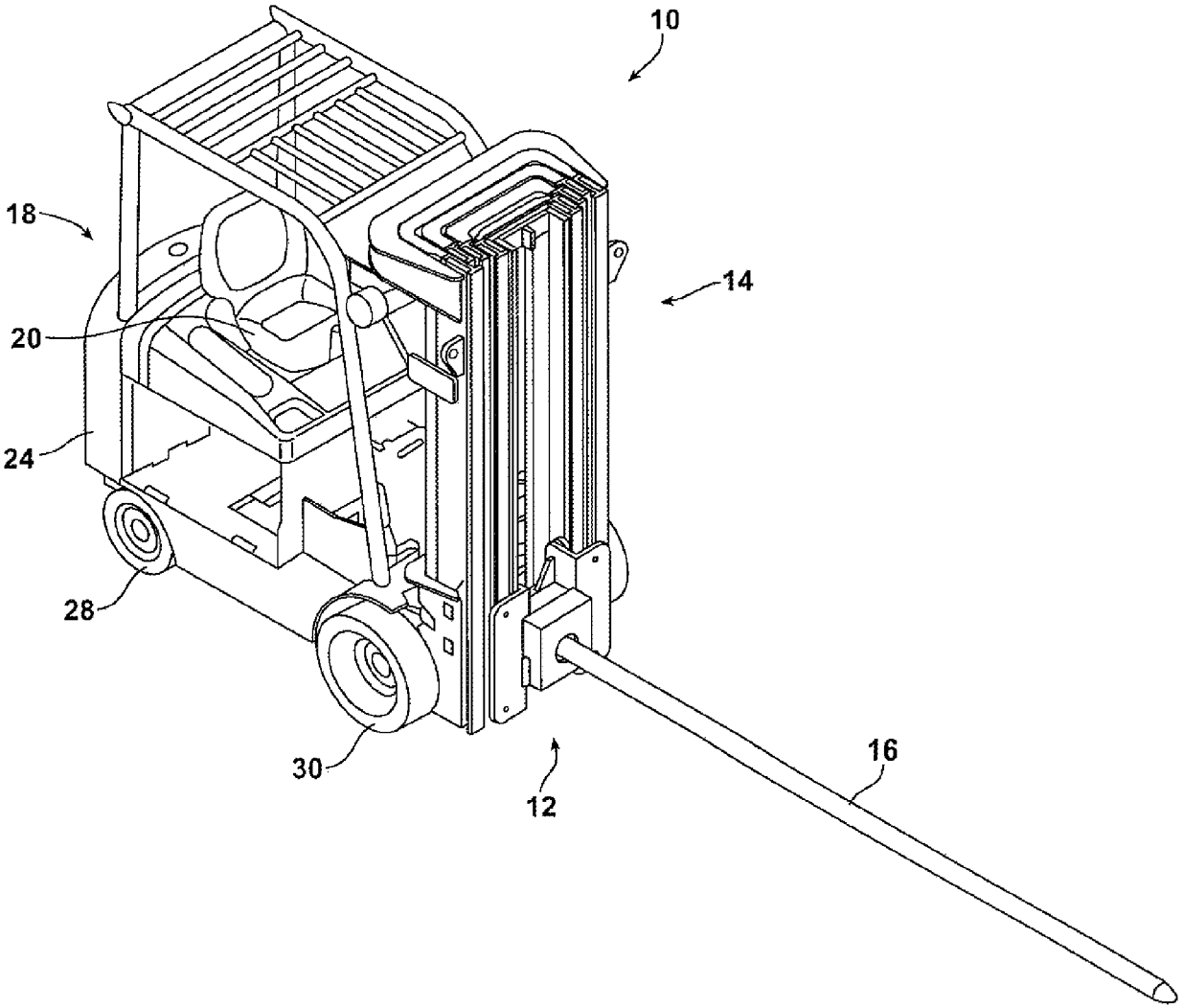
FIG. 1 is a perspective view of a lift truck incorporating the carpet pole carriage assembly of the present invention in the fully lowered position.
Figure 2:
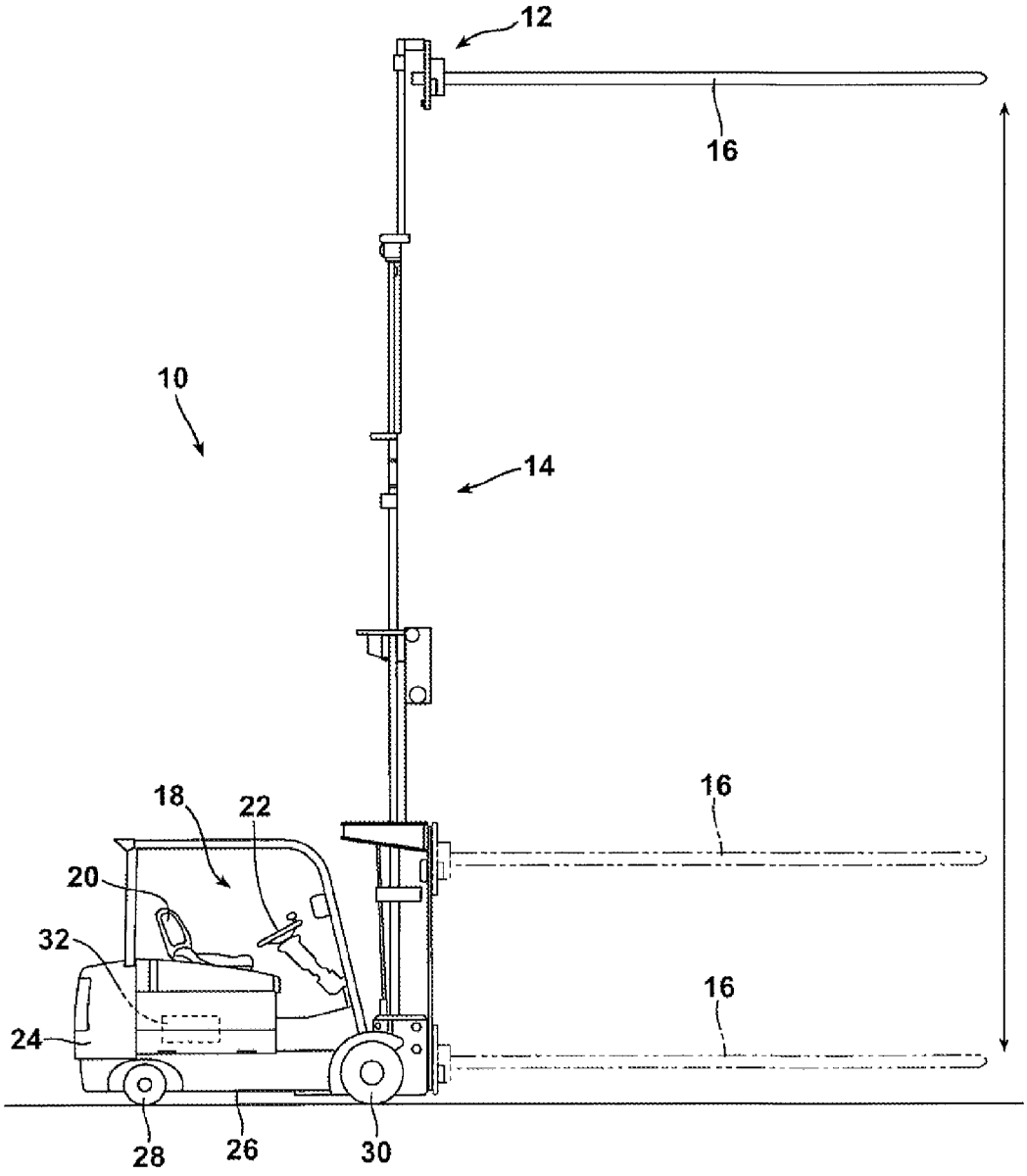
FIG. 2 is a side elevational view illustrating the carpet pole carriage assembly in the fully raised position.

Reference is now made to FIGS. 1 and 2 showing a lift truck 10 equipped with the five stage upright 14 of the present invention. As illustrated, the lift truck 10 is also equipped with a carpet pole carriage assembly 12. The five stage upright 14 allows the carpet pole carriage assembly 12, including the carpet pole 16, to be moved from a lower most position illustrated in FIG. 1 to a fully extended uppermost position illustrated in FIG. 2. As should be appreciated, the lift truck 10 includes a cab 18 having a seat 20, and operator controls 22. The lift truck 10 also includes body work 24 held on a frame 26 equipped with steerable wheels 28 and drive wheels 30 for maneuvering the lift truck over a surface. A drive system 32 for propelling the lift truck 10 and operating lift truck systems is positioned on the frame 26 under the body work 24.

Figure 3A:
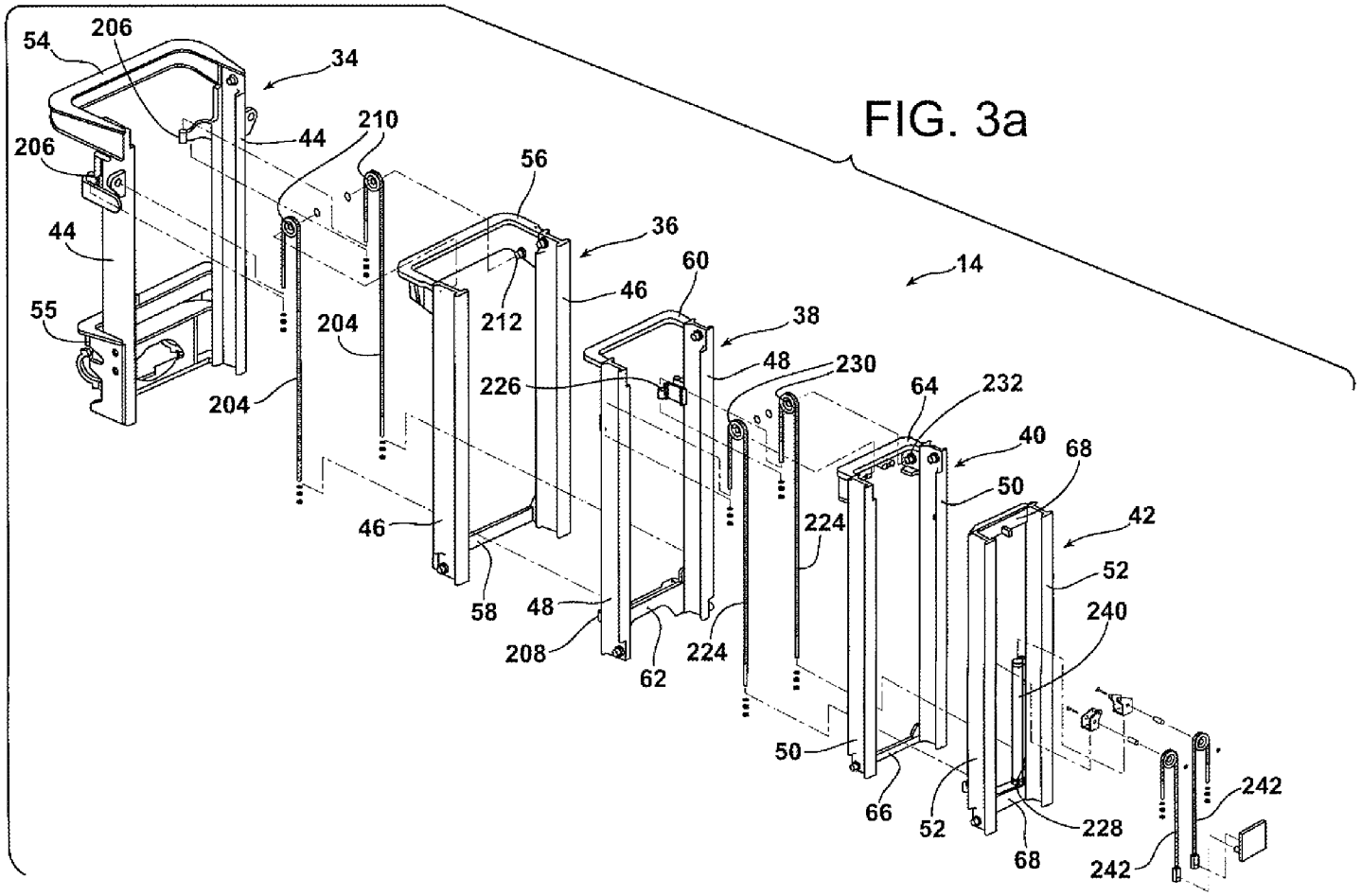
FIGS. 3*a* and 3*b* are detailed, exploded perspective views illustrating the five stage upright used on the lift truck illustrated in FIGS. 1 and 2.
Figure 3B:
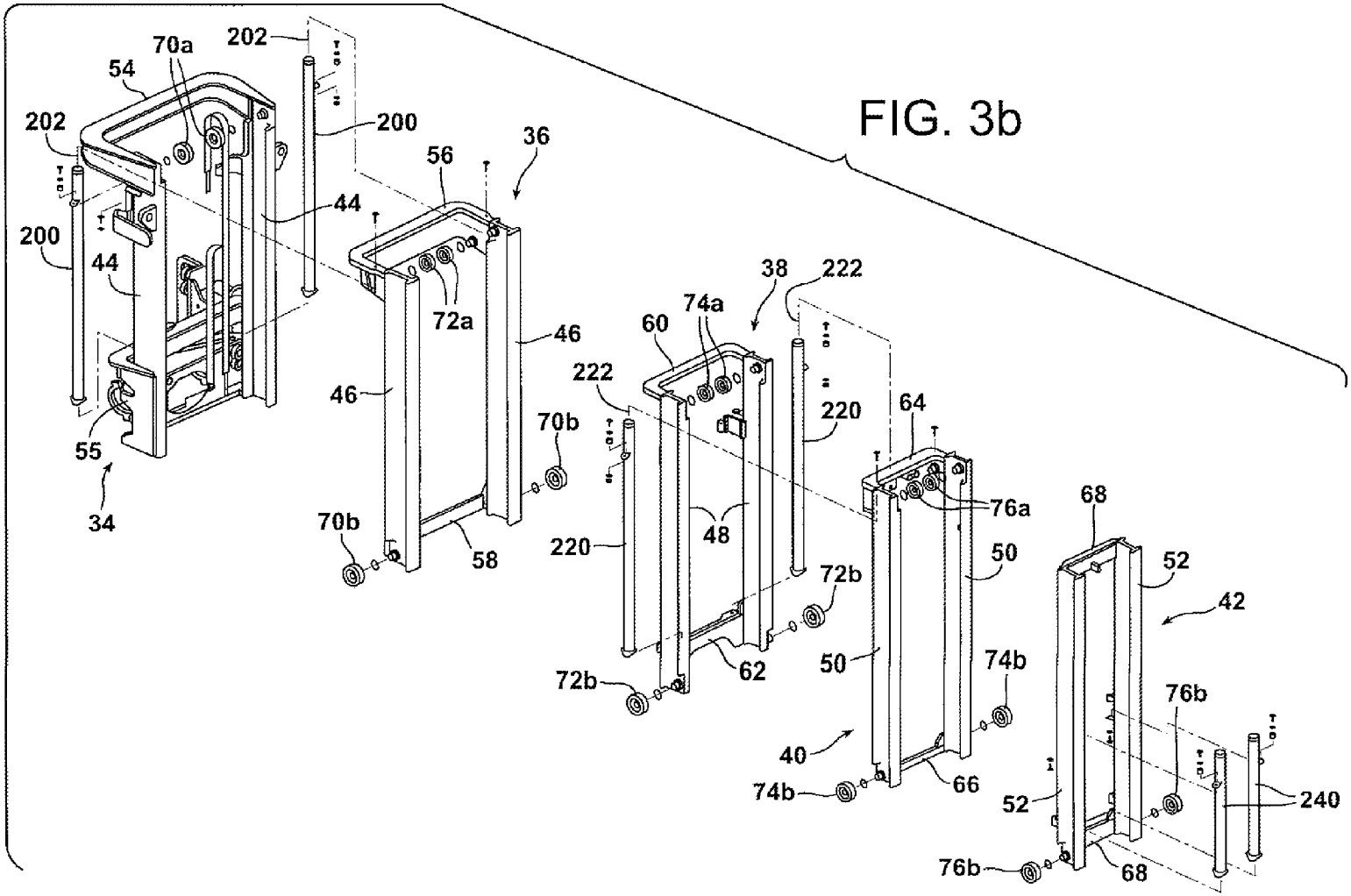
Figure 4A:
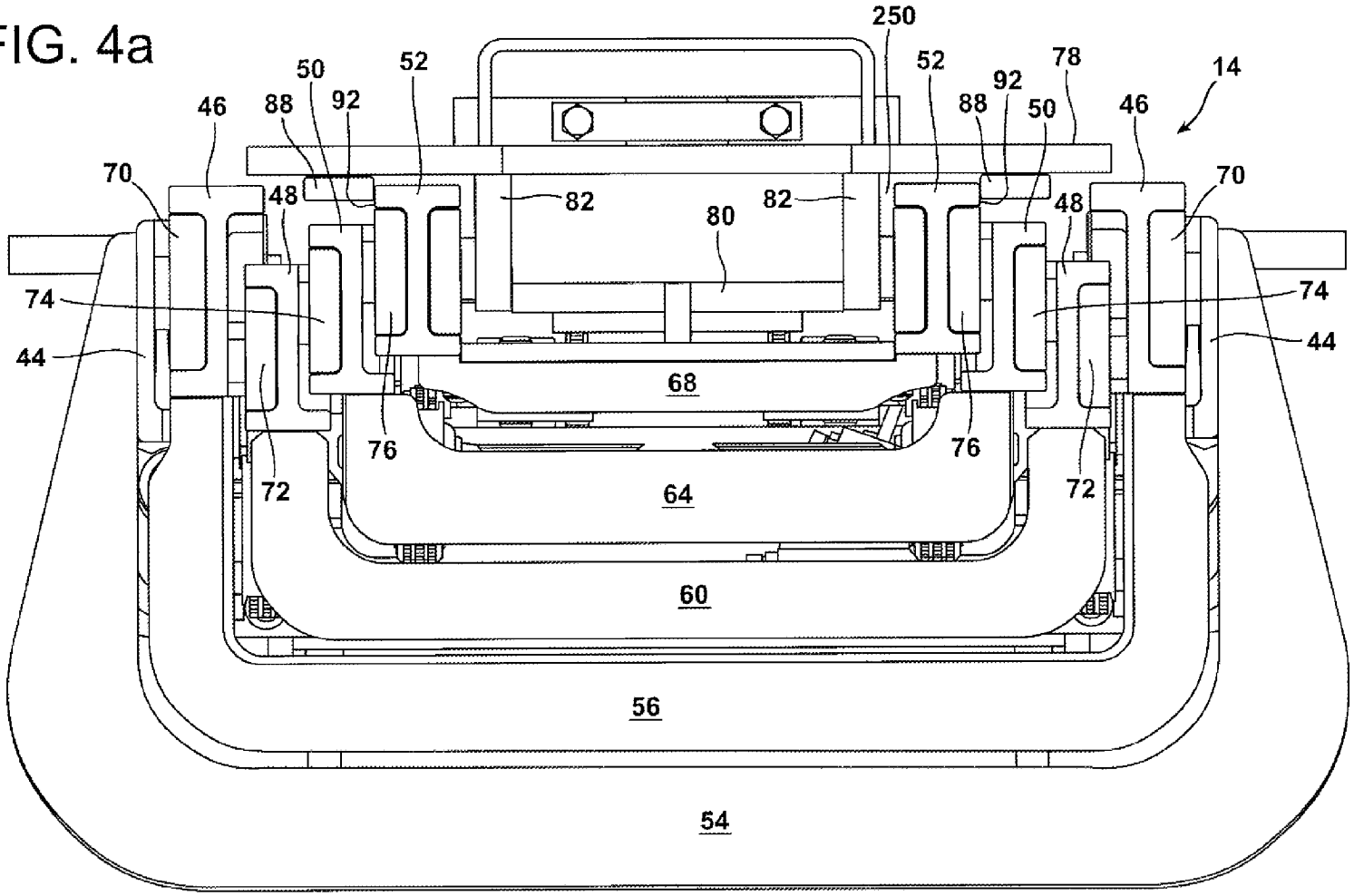
FIG. 4*a* is a detailed, top plan view of that five stage upright in the fully lowered position.
Figure 4B:
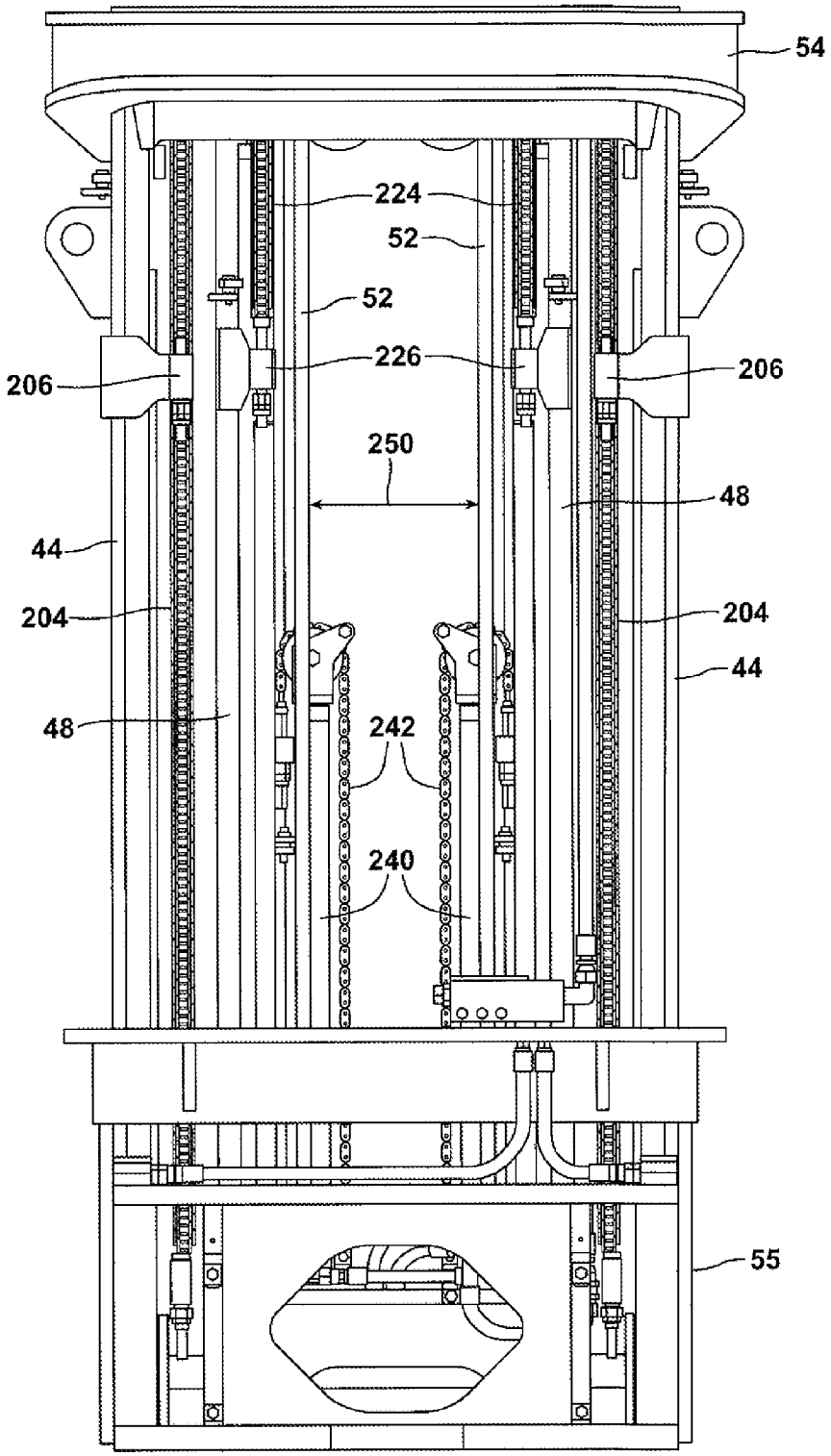
FIG. 4*b* is a detailed rear elevational view of the five stage upright also in the fully lowered position.

Reference is now made to FIGS. 3, 4*a* and 4*b* which illustrate the five stage upright 14 in detail. As illustrated, the five stage upright 14 includes first, second, third, fourth and fifth mast sections 34, 36, 38, 40, 42 in telescoping relation to each other. Each mast section 36, 38, 40, 42 comprises a pair of laterally spaced interconnected telescopic I-beam rails 46, 48, 50, 52 respectively. The first mast section 34 comprises a pair of laterally spaced C-beam rails 44. As best illustrated in FIG. 4*a*, the rails 44, 46, 48, 50 and 52 are mounted and nested in overlapping relation to each other. Accordingly, the first or outer mast section 34 receives the second mast section 36 which receives the third mast section 38 which receives the fourth mast section 40 which receives the fifth mast section 42.

As illustrated, the rails 44 of the first mast section 34 are secured together by upper and lower u-shaped tie bars 54, 55. Lower tie bar 55 is secured to the frame 26 of the lift truck 10 by a series of pins (not shown) in order to mount the five stage upright 14 to the lift truck 10.

The rails 46 of the second mast section 36 are connected together by a tie bar 56 and a cross bar 58. The rails 48 of the third mast section 38 are secured together by the tie bar 60 and cross bar 62. The rails 50 of the fourth mast section 40 are secured together by the tie bar 64 and cross bar 66. The rails 52 of the fifth mast section 42 are secured together by the two cross bars 68. The u-shaped tie bars 54, 55, 56, 60 and 64 and the cross bars 58, 62, 66 and 68 are arranged so that they pass inside of each other as required during movement of the mast sections 34, 36, 38, 40 and 42 relative to each other. Thus, it should be appreciated that there is no interference between the tie bars 54, 55, 56, 60 and 64 and cross bars 58, 62, 66 and 68 of the mast sections 34, 36, 38, 40, 43 during telescopic movement in either direction.

As best illustrated in FIGS. 3*b* and 4*a*, opposing guide rollers 70*a* are secured to the rails 44 of the first mast section 34. These rollers 70*a* are received in the outer channel of the rails 46 of the second mast section 36. Two rollers 70*b* are also provided on the outer channel of the rails 46 of the second mast section 36. Together, the rollers 70*a*, 70*b* support the second mast section 36 for smooth telescoping movement relative to the first mast section 34. Similarly, rollers 72*a* mounted to the inner channel of the rails 46 of the second mast section 36 are received in the outer channel of the rails 48 of the third mast section 38. Two additional rollers 72*b* are provided on the outer channel of the rails 48 of the third mast section 38. Together, the rollers 72*a*, 72*b* support the third mast section 38 for smooth telescoping movement relative to the second mast section 36. Two rollers 74*a* secured to the inner face of the rails 48 of the third mast section 38 are received in the outer channel of the rails 50 of the fourth mast section. Two additional rollers 74*b* are secured on stub shafts to the outer channel of the rails 50 of the fourth mast section 40. Together, the rollers 74*a* and 74*b* support the fourth mast section 40 for smooth telescoping movement relative to the third mast section 38. Two rollers 76*a* secured to the inner face of the rails 50 of the fourth mast section 40 are received in the outer channels of the rails 52 of the fifth mast section 42. Two additional rollers 76*b* secured to the inner channel of the rails 52 of the fifth mast section 42 engage the outer channel of the rails 50 of the fourth mast section 40. Together the rollers 76*a*, 76*b* support the fifth mast sections 42 for smooth telescoping movement relative to the fourth mast section 40. As should be appreciated, the forward face of the rails 46 of the second mast section 36 are substantially aligned with the forward face of the rails 52 of the fifth mast section 42. This is accomplished by means of a reverse nesting arrangement. The carpet pole carriage assembly 12 is mounted for translational movement along the rails 52 of the fifth mast section 42.

A first set of lift cylinders 200 is secured to the first mast section 34 (see FIGS. 3*a*, 3*b* and 4*b*). The lift cylinders 200 include pistons 202 having distal ends connected to the tie bar 56 of the second mast section 36. A first set of lift chains 204 have first ends connected by the brackets 206 to the first mast section 34 and second ends connected by brackets 208 to the third mast section 38. The lift chains 204 also engages sheaves 210 held on stub shafts 212 carried on the tie bar 56 of the second mast section 36.

A second set of lift cylinders 220 are secured to the third mast section 38. The lift cylinders 220 include pistons 222 having distal ends connected to the tie bar 64 of the fourth mast section 40. A second set of lift chains 224 have first ends connected by the brackets 226 to the third mast section 38 and second ends connected by brackets 228 to the fifth mast section 42. The lift chains 224 also engage sheaves 230 held on stub shafts 232 carried on the tie bar 64 of the fourth mast section 40.

The lift cylinders 200, 220 and first and second sets of lift chains 204, 224 allow the operator to fully raise and lower the upright 14 between the fully lowered and raised positions illustrated in FIGS. 1 and 3 in a manner known in the art.

Figure 5:
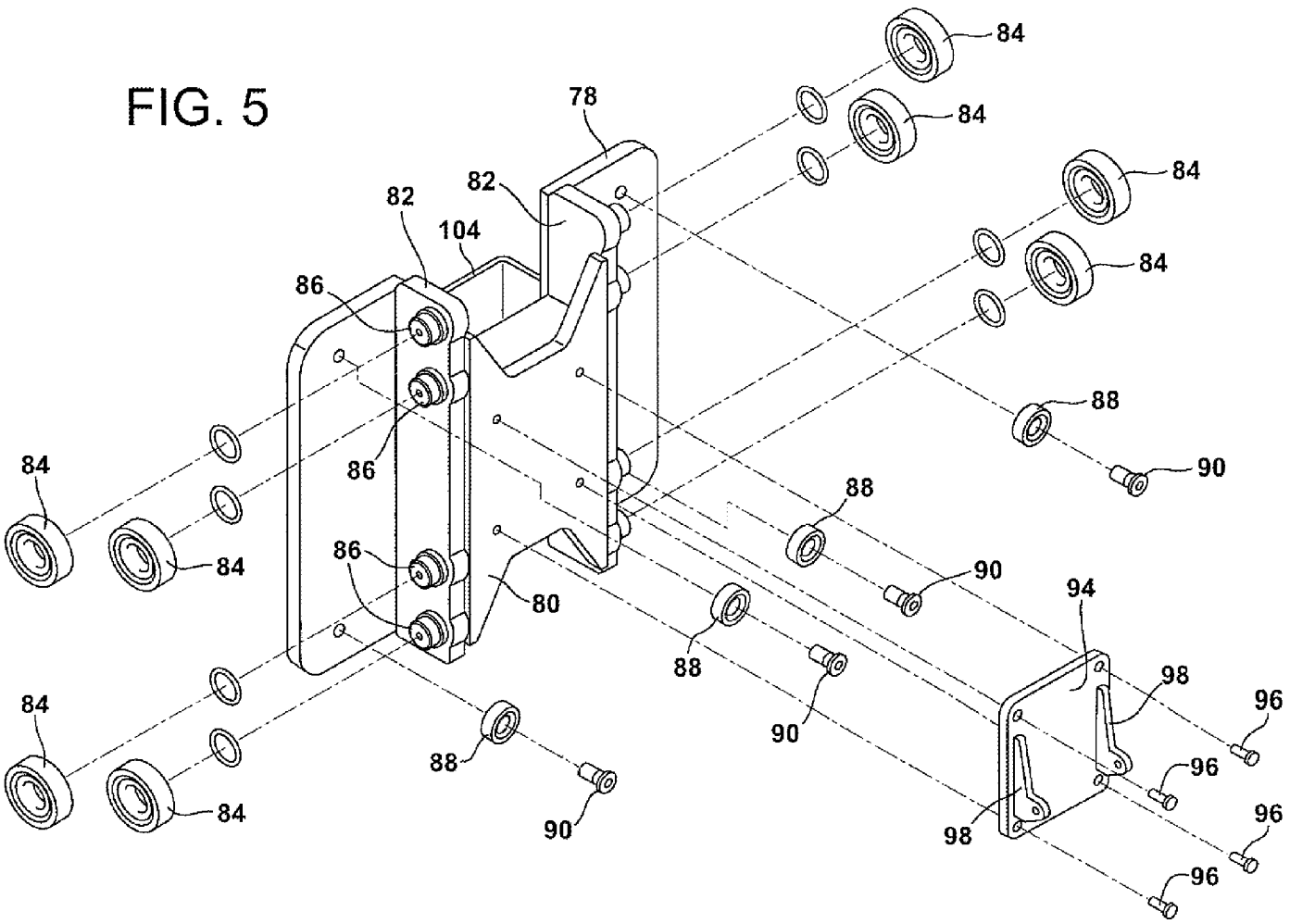
FIG. 5 is an exploded perspective view of the rear of the carpet pole carriage assembly.

As best illustrated in FIGS. 3*a*, 3*b* and 5, the carpet pole carriage assembly 12 includes a front plate 78, a back plate 80 and two opposing sidewalls 82. Four rollers 84 are mounted on spaced stub-shafts 86 along each side wall. These rollers 84 are received in the inwardly facing channels of the mast sections 52 of the fifth mast section 42 so as to provide smooth movement of the carpet pole carriage assembly 12 along the fifth mast section. The increased roller spread and the large number of rollers 84 spread the load evenly and increase bearing life. Four side thrust rollers 88 are secured by pins 90 to the rear of the front plate 78. These side thrust rollers 88 engage along the outer edge 92 of the mast sections 52 to resist shifting of the carpet pole carriage assembly 12 from side-to-side along the five state upright 14 thereby reducing deflection wear of the main carriage rollers 84. As should be appreciated, space for the rollers 88 exist between the rails 46 and rails 52 thanks to the reverse nest arrangement of the mast sections 34, 36, 38, 40 and 42. A carriage lift bracket 94 is secured to the back plate 80 by cap screws 96. The carriage lift bracket 94 includes two opposing devices 98 that allow connection to the lift cylinders 240 and cooperating chain system 242 that lifts and lowers the carpet pole carriage assembly 12 on the fifth mast section 42.

Figure 6:
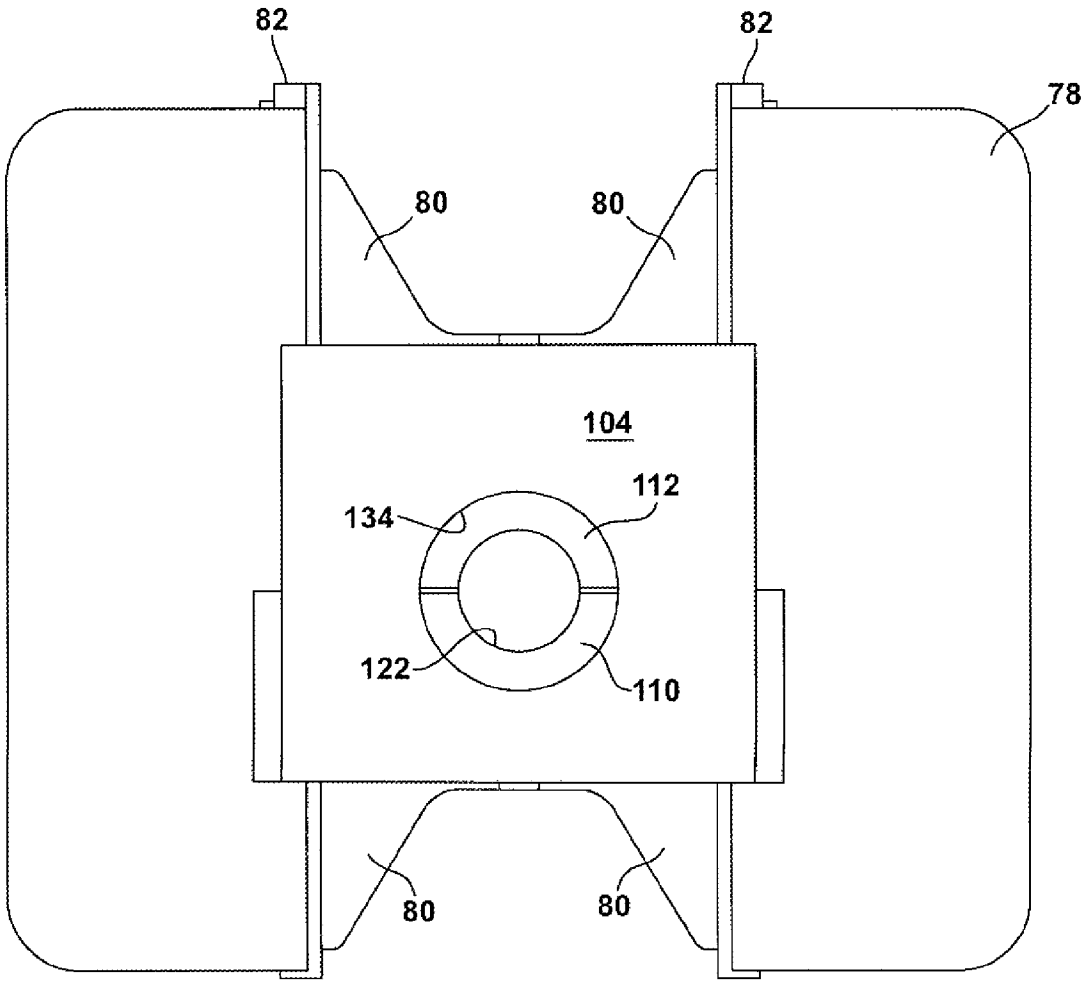
FIG. 6 is a front elevational view of the carpet pole carriage assembly.
Figure 7:
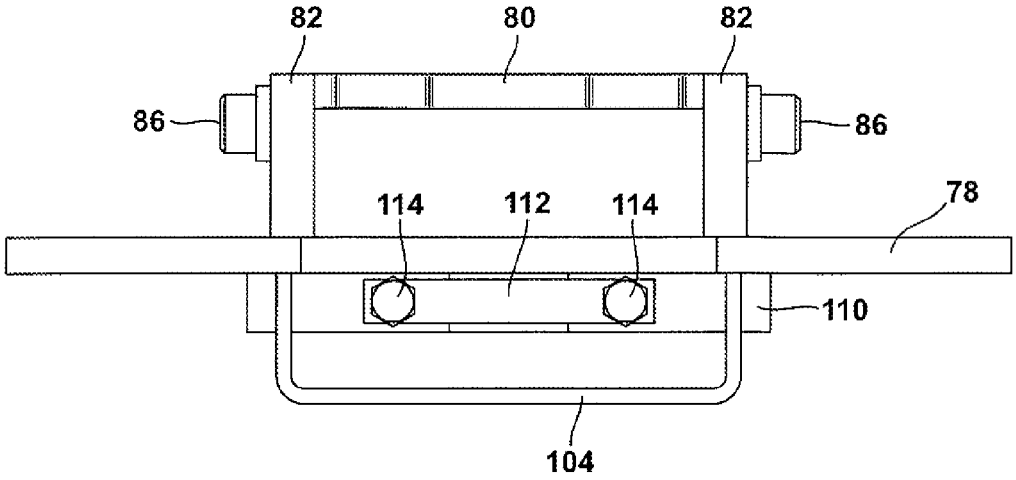
FIG. 7 is a detailed, top plan view of the carpet pole carriage assembly.
Figure 8:
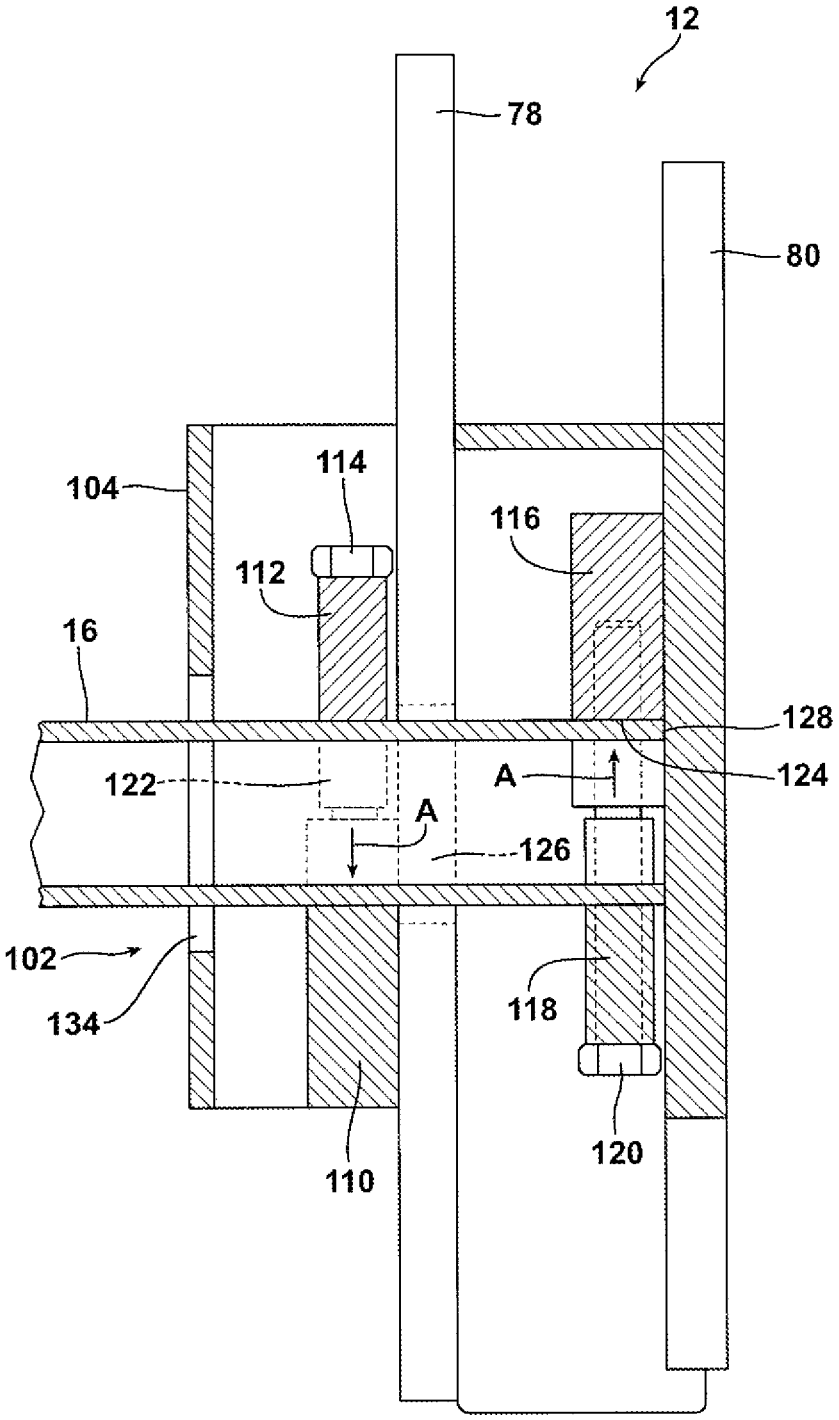
FIG. 8 is a detailed, cross sectional view of the carpet pole carriage assembly.

Reference is now made to FIGS. 6-8 illustrating the carpet pole retainer 102 and core protector 104 on the carpet pole carriage assembly 12. As illustrated, the carpet pole retainer 102 includes a first section 106 secured to the front plate 78 and a second section 108 secured to the back plate 80. The first section 106 of the carpet pole retainer 102 includes a first mounting block 110 secured to the front plate 78 by welding or other appropriate means and a first retainer cap 112 secured to the first mounting block 110 by a first adjustable fastener 114. Similarly, the second section 108 includes a second mounting block 116 secured by welding or other means to the back plate 80 and a second retainer cap 118 secured to the second mounting block by a second adjustable fastener 120. In the illustrated embodiment, the first adjustable fastener 114 and the second adjustable fastener 120 both take the form of two threaded bolts.

As should be appreciated the first mounting block 110 and first retainer cap 112 form a first mounting aperture 122 while the second mounting block 116 and second retainer cap 118 form a second mounting aperture 124. The first and second mounting apertures 122, 124 are aligned with a carpet pole receiving opening 126 in the front plate 78.

Figure 9:
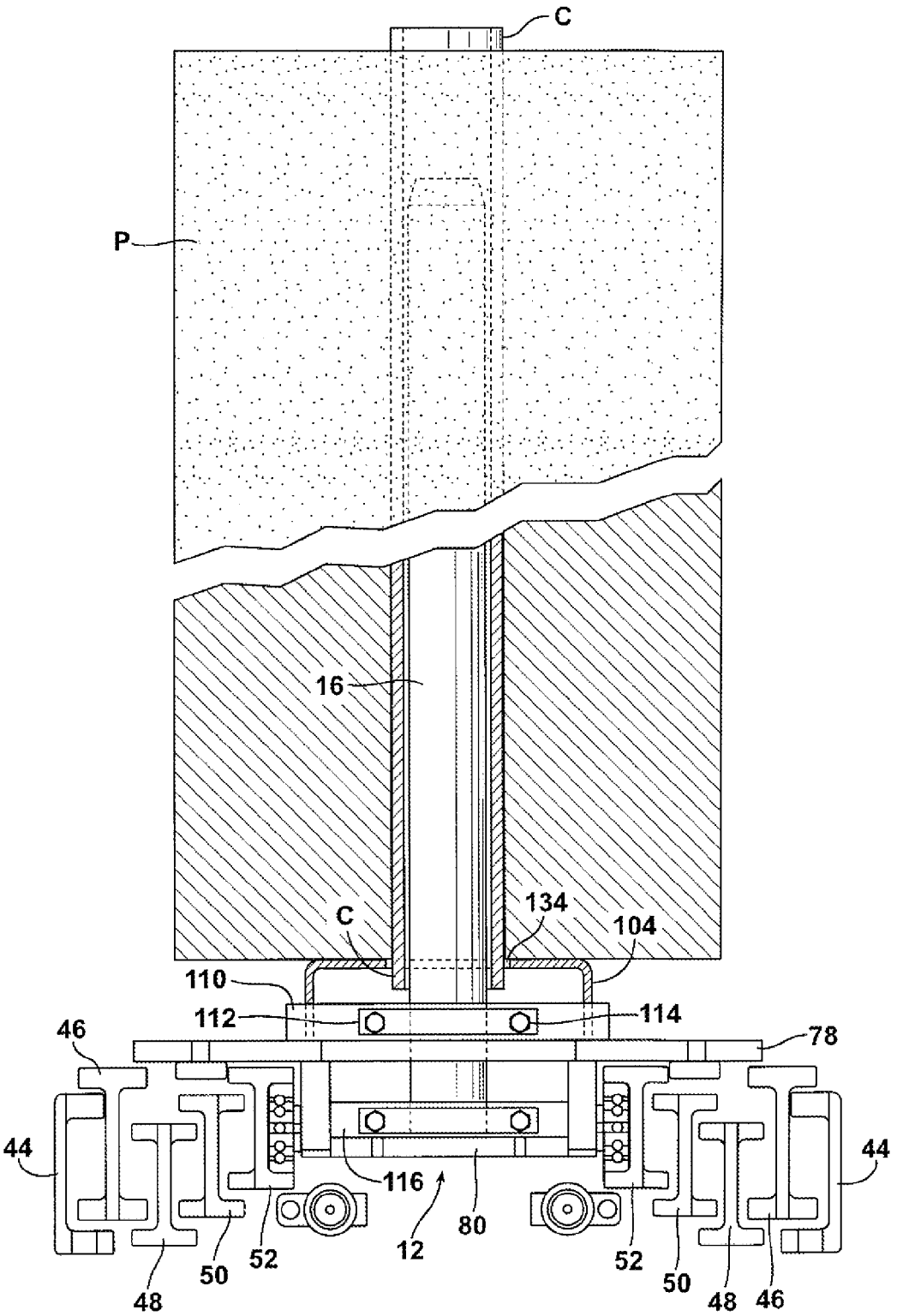
FIG. 9 is a schematical top plan view illustrating how the carpet pole assembly is utilized to engage and lift a carpet rolled into a paper core.

A carpet pole 16 is secured in the carpet pole retainer 102 by inserting the proximal end of the pole through the first mounting aperture 122, the carpet pole receiving opening 126 and the second mounting aperture 124 (see FIGS. 8 and 9). The retaining caps 112 and 118 are then tightened down by the adjustable fasteners 114, 120 to secure the carpet pole in position in the retainer 102. As should be appreciated, the first and second mounting blocks 110, 116 which are fixed to the respective plates 78, 80 engage the loaded sides 120 (note action arrows A) of the carpet pole 16 while the first and second retainer caps 112, 118 and the fasteners 114 engage unloaded sides 132 of the carpet pole. This results in reduced stress on the carpet pole 16 as well as on the carpet pole retainer 102. The system also allows easy removal of the pole 16 by simply loosening the retainer caps 112, 118.

The core protector 104 comprises a substantially u-shaped plate that may be welded or otherwise connected to the front plate 78. The core protector 104 includes a carpet core receiving opening 134 that is aligned with the carpet pole receiver opening 126 in the front plate 78 as well as the first and second mounting apertures 122, 124 of the carpet pole retainer 102. The core C upon which the carpet P is wrapped has an outer diameter $D_4$ and an inner diameter $D_5$. The carpet core receiving opening 134 of the core protector 104 has an outer diameter $D_1$ which is less than $D_5$ and the carpet pole receiving opening 126 has a diameter $D_2$ which is greater than $D_4$. Thus, it should be appreciated that the carpet pole 16 will easily slip inside the core C upon which the carpet P is wound. Typically the core C is longer in length than the rolled carpet P and contact between the carriage assembly and the core has caused damage to the core in the past. The carpet core protector 104 addresses this problem. More specifically, as the carpet pole 16 is inserted into the core, the end of the core passes through the carpet core receiving opening 134 and the core protector 104 until the face of the core protector engages the carpet P wound on the core C. The clearance provided by the core protector 104 protects the core C from engagement with the carriage assembly 12 and potential damage to the core that might otherwise be caused by such engagement during handling.

Figure 10A:
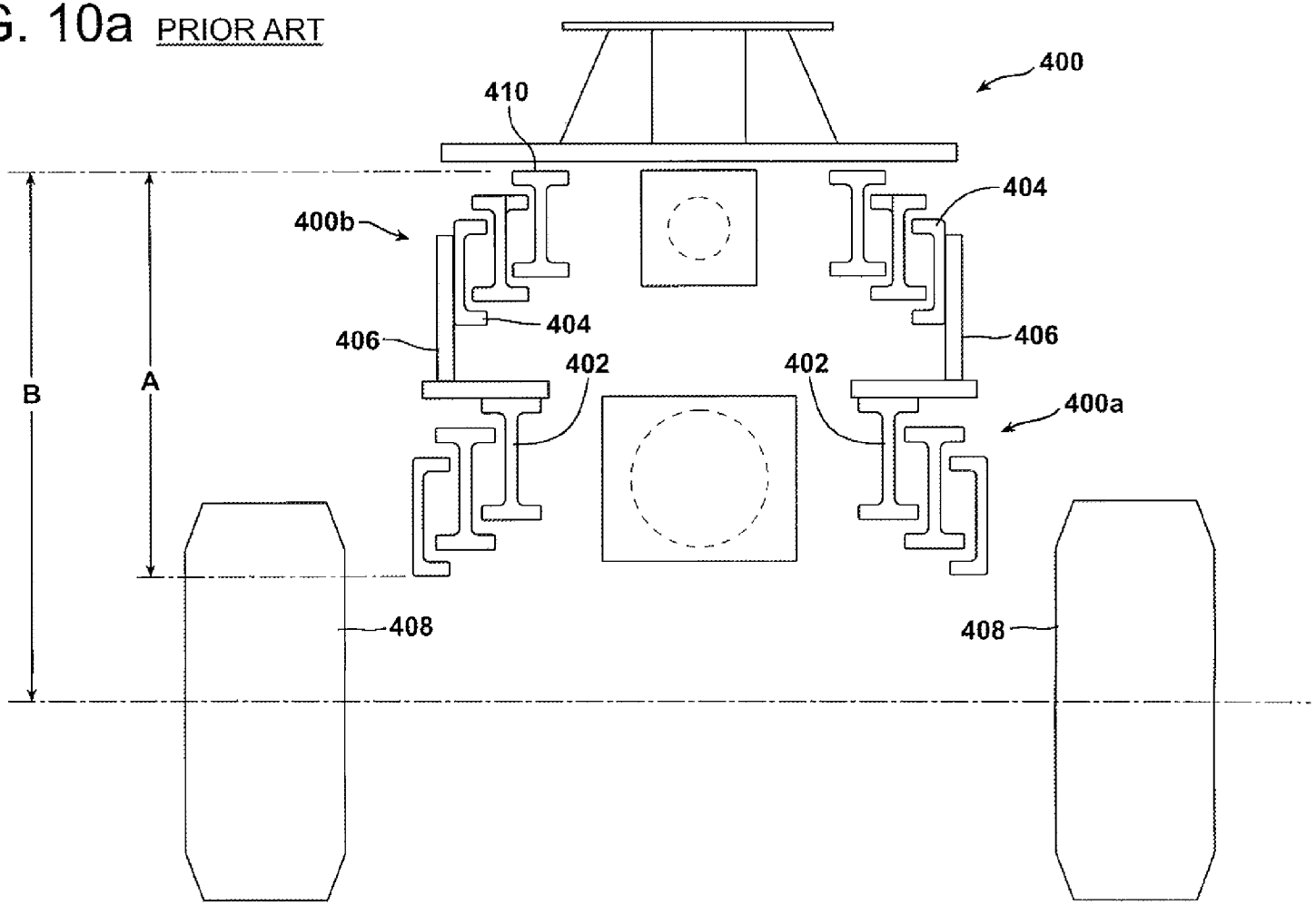
FIG. 10a PRIOR ART
FIGS. 10*a*-10*c* schematically illustrate and compare the architecture of the prior art "six-pack" and "quad-plus-one" five stage uprights to the five stage upright of the present invention.
Figure 10B:
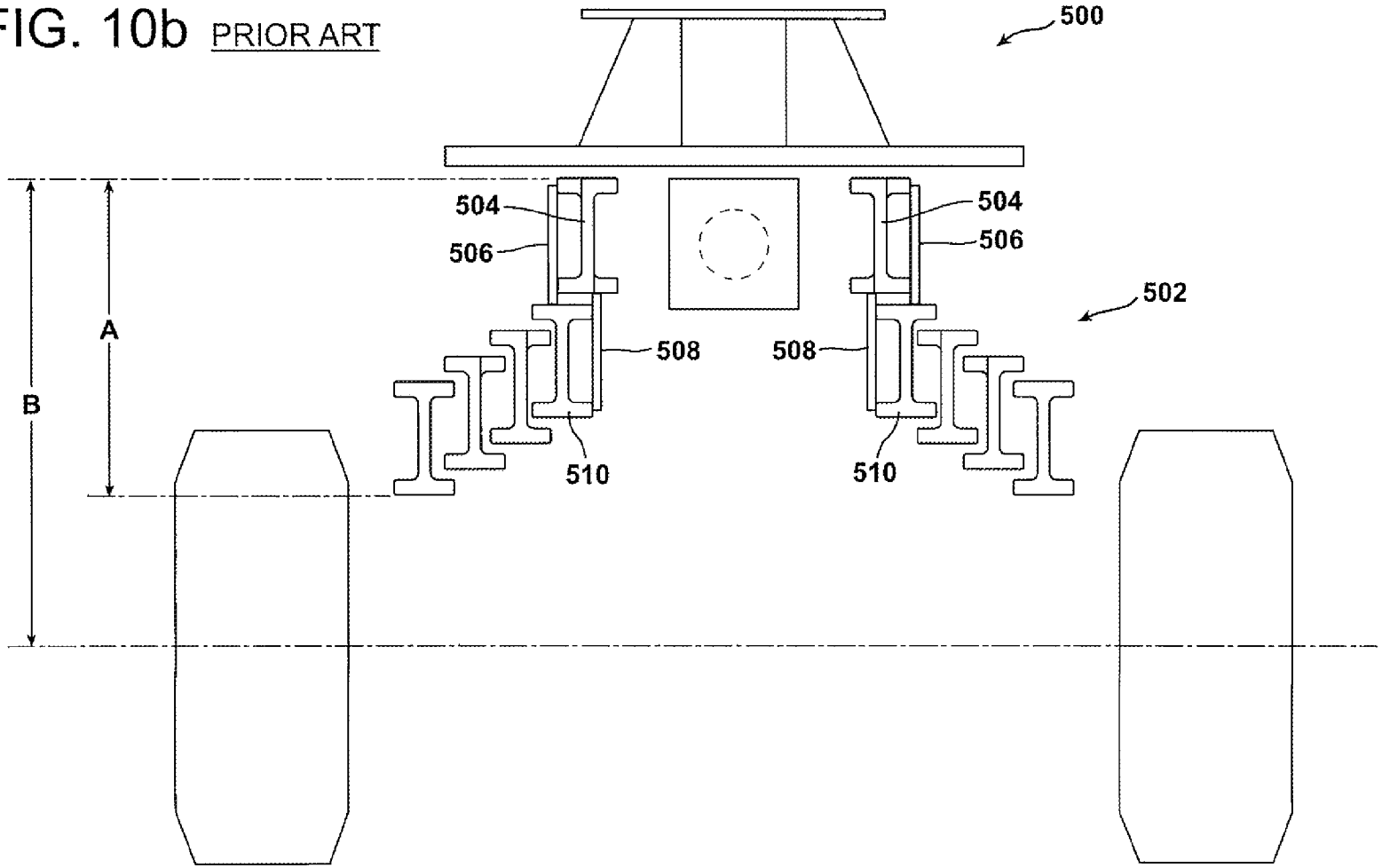
FIG. 10b PRIOR ART
Figure 10C:
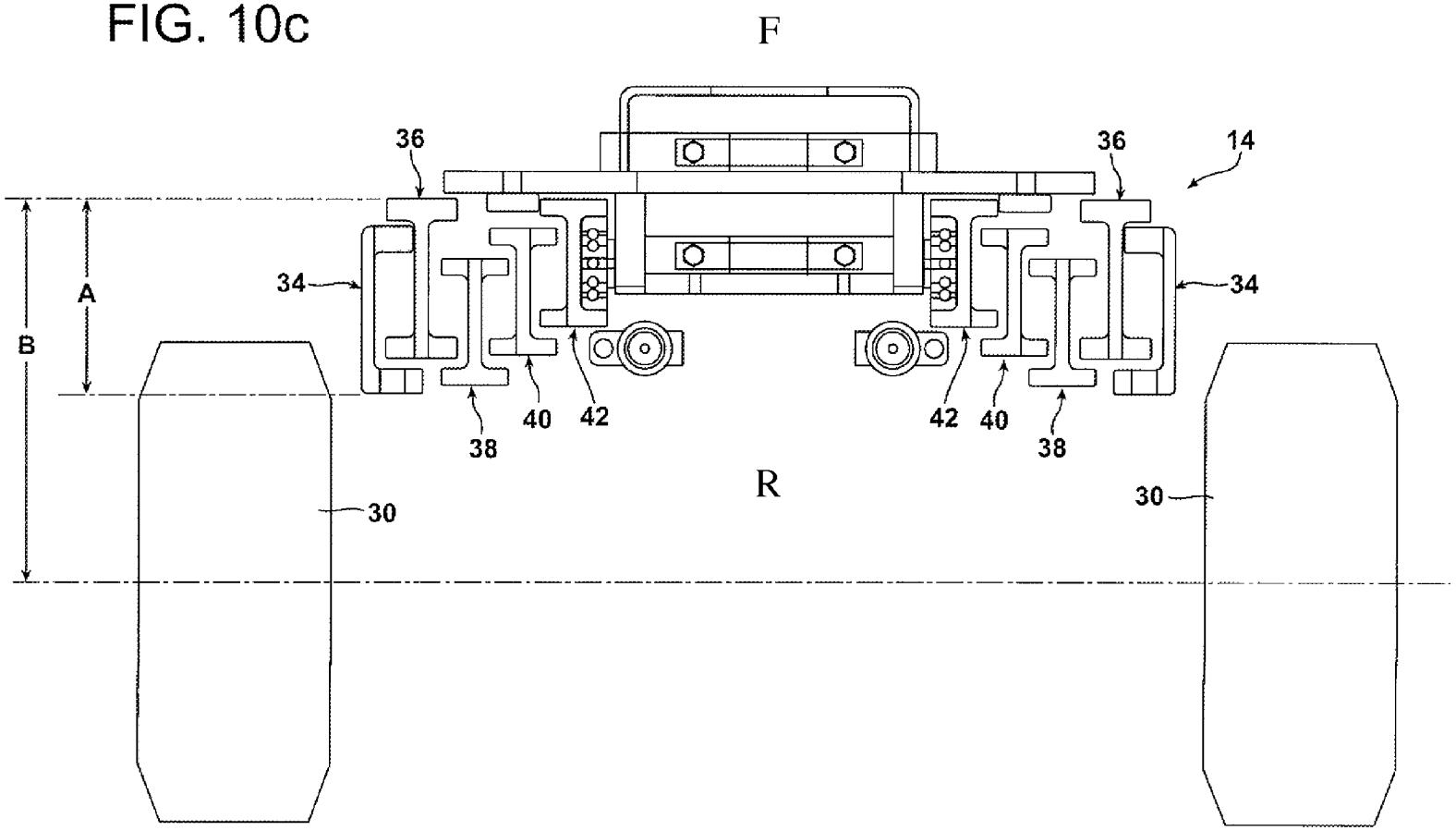

Reference is now made to FIGS. 10*a*-10*c* comparing the prior art six-pack upright illustrated in FIG. 10*a* and the prior art quad-plus-one upright illustrated in FIG. 10*b* with the five stage upright of the present invention illustrated in FIG. 10*c*.

As illustrated in FIG. 10*a*, the six-pack upright 400 includes first and second triple stage upright systems 400*a*, 400*b* that are welded or otherwise fixed together. More specifically, the third mast section 402 of the first triple stage upright system 400*a* is fixed to the first mast section 404 of the second triple stage upright system 400*b* by means of the connecting brackets 406.

The positioning of the second triple stage upright system 400*b* in front of the first triple stage upright system 400*a* adds very significantly to the overall fore/aft dimension A of the six-pack upright 400. As a result, the load center B from the centerline of the drive wheels 408 to the front face 410 of the six-pack upright 400 is quite long. In fact, a six-pack upright 400 with a capacity of 2000 lbs would have a fore/aft dimension A of about 20 inches and load center B of about 36 inches.

It should also be appreciated that six mast section sets 402, 404, 412, 414, 416, 418 are required to provide five lift stages since the mast sections 402 and 404 are fixed together through the brackets 406. The "extra" mast section and the brackets 406 add significant weight to the upright 400 that effectively reduces its lifting capacity. Between the added weight and the long load center, lifting capacity is significantly reduced and as a result, a larger upright and a larger lift truck are required to lift a given load. A larger lift truck includes larger, more expensive batteries and represents a significant additional cost to purchase, operate and maintain. Thus, while a six-pack upright provides the desired five stage lift function, it should be appreciated that it does so in a relatively inefficient manner.

Reference is now made to FIG. 10*b* illustrating the quad-plus-one upright 500. The quad-plus-one upright 500 includes a standard four mast section or quad upright system 502 connected to an additional mast section 504. More specifically, a first plate 506 is connected to each side of the mast section 504 and a second plate 508 is connected to each side of the forward-most mast section 510 of the quad upright system 502. The plates 506 and 508 include rollers (not shown) that support the mast section 504 as it telescopes along the mast section 510.

As should be appreciated from viewing FIG. 10*c*, the five stage upright 14 of the present invention includes two outer mast sections 34, 36 in a first group and three inner mast sections 38, 40, 42 in a second group. As illustrated, the first group of two mast sections 34, 36 is in a forward stagger: that is the forwardmost portion of the second mast section 36 is more forward (note reference letter F) than the forwardmost portion of the first mast section 34. Similarly, the second group of mast sections 38, 40, 42 is in a forward stagger. In contrast, the second group of mast sections 38, 40, 42 is reverse nested inside the first group of mast sections 34, 36: that is, the forwardmost portion of the third mast section 38 is rearward (note reference letter R) of the forwardmost portion of the first and second mast sections 34, 36. This reverse nesting arrangement allows the three mast sections 38, 40, 42 of the second group to fit fully within the fore/aft dimension of the mast sections 34, 36 of the first group. Since no one mast section is positioned forward of any other mast section as is characteristic of the six-pack and quad-plus-one upright systems 400, 500, the overall fore/aft dimension A of the upright 14 is significantly reduced. This, in turn, significantly reduces the load center B. As a result, the load capacity of the upright 14 is much higher than for six-pack and quad-plus-one uprights of a given size. For example, a five stage upright 14 of the present invention having a lifting capacity of 2200 lbs. has a total fore/aft dimension A of about 13 inches and a load center B of about 21.4 inches.

As should be appreciated from viewing FIG. 10*c*, the five stage upright 14 of the present invention includes two outer mast sections 34, 36 in a first group and three inner mast sections 38, 40, 42 in a second group reverse nested inside the first group. This reverse nesting arrangement allows the three mast sections 38, 40, 42 of the second group to fit fully within the fore/aft dimension of the mast sections 34, 36 of the first group. Since no one mast section is positioned forward of any other mast section as is characteristic of the six-pack and quad-plus-one upright systems 400, 500, the overall fore/aft dimension A of the upright 14 is significantly reduced. This, in turn, significantly reduces the load center B. As a result, the load capacity of the upright 14 is much higher than for six-pack and quad-plus-one uprights of a given size. For example, a five stage upright 14 of the present invention having a lifting capacity of 2200 lbs has a total fore/aft dimension A of about 13 inches and a load center B of about 21.4 inches.

By reducing the fore/aft dimension of the five stage upright 14 and eliminating weight, it is possible to achieve greater lift capacity using a smaller lift truck. This reduces capital cost as well as operating and maintenance expenses. A smaller truck is also more maneuverable and can be operated in narrower aisle-ways thereby providing for more storage area in a warehouse of given space.

It should also be appreciated that the five stage upright 14 of the present invention is widened as much as possible so as to just fit inside the drive wheels 30 of the lift truck 10. This not only adds stability but functions to provide a relatively wide viewing window between the rails 52 of the innermost mast section 42. The hydraulic hosing that is used to supply pressurized oil to the lifting cylinders is anchored with adjustable brackets to allow for readjusting hose tension as the lift chains wear, and is routed through the upright so that there are no hoses in the vision window. Lift chains are anchored at each end with self-aligning chain anchors that prevent chain side loading to extend the life of the chain. The lift chains are optimized for the lighter loads and the reduced chain pitch allows smaller diameter chain sheaves. This allows the chains to be located completely behind the mast sections without encroaching into the vision window. The lifting hydraulic cylinders are downsized to be optimum for the lighter, longer 2200 lb loads typical of rolled carpet. The beneficial results are less intrusion into the vision window and increased lift speeds for reduced lifting time for the high lifting requirement.

The foregoing description of the preferred embodiments of the present invention have been presented for purposes of illustration and description. It is not intended to be exhaustive or to limit the invention to the precise form disclosed. Obvious modifications or variations are possible in light of the above teachings. For example, while the lift truck 10 is illustrated as being equipped with a carpet pole carriage assembly 12, it should be appreciated that substantially any type of carriage assembly known for use on a lift truck may be utilized including, but not limited to, an assembly with a fork arrangement.

The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. An upright for a lift truck, comprising:

a first group of mast sections including a first mast section and a second mast section in a first stagger arrangement, said first mast section being fixed to the lift truck;

a second group of mast sections including a third mast section, a fourth mast section and a fifth mast section in a second stagger arrangement nested inside said first stagger arrangement; and a carriage assembly mounted for translational movement along said fifth mast section; and a drive system for telescopically extending and retracting said mast sections relative to said first mast section.

2. The upright of claim 1, wherein said carriage assembly includes a carpet pole.

3. The upright of claim 1, wherein said first stagger arrangement and said second stagger arrangement are both forward staggers.

4. A method of manufacturing an upright with an improved load center and a reduced overall fore/aft dimension, comprising:

providing a five stage upright with only five mast sections;

providing a first group of said five mast sections in a first stagger arrangement;

providing a second group of five mast sections in a second stagger arrangement reverse nested inside said first stagger arrangement.

5. The method of claim 4, including forwardly staggering said first and second group of five mast sections.

* * * * *